US006012938A

United States Patent [19]

Newman et al.

[11] Patent Number: 6,012,938

[45] Date of Patent: Jan. 11, 2000

[54] ANTI-THEFT LAMP ADAPTER

[75] Inventors: Walter Newman, Bayside; David B. Balaban, Hauppauge, both of N.Y.

[73] Assignee: Leviton Manufacturing Co., Inc., Little Neck, N.Y.

[21] Appl. No.: 09/108,602

[22] Filed: Jul. 1, 1998

Related U.S. Application Data

[62] Division of application No. 08/686,789, Jul. 26, 1996, Pat. No. 5,788,525.

[51] Int. Cl.[7] ..... H01R 31/06

[52] U.S. Cl. ..... 439/306; 439/304; 29/854

[58] Field of Search ..... 439/306, 307, 439/310, 236, 641, 642, 645; 29/854, 857

[56] References Cited

U.S. PATENT DOCUMENTS 992,084 5/1911 Trulock ..... 439/307
1,082,397 12/1913 Blass ..... 439/306
1,506,184 8/1924 Kellner ..... 434/307
1,786,409 12/1930 Moore ..... 439/306

*Primary Examiner*—Hien Vu
*Attorney, Agent, or Firm*—Paul J. Sutton

[57] ABSTRACT

An adapter for lamps and other electrical devices to be installed in standard lampsockets which prevents unauthorized removal of such lamps or other electrical devices. A screwshell means is placed upon a body member such that relative rotation between them is possible. A tool or key placed in aligned slots or keyways prevents relative rotation so that the adapter can be installed or removed from a lampsocket. The tool or key is then removed permitting relative rotation again, whereby the lamp or other electrical device cannot be removed from the lampsocket. Use of the tool or key fixes the two components with respect to one another and the adapter can be removed.

2 Claims, 5 Drawing Sheets

ANTI-THEFT LAMP ADAPTER

This application is a division of application Ser. No. 08/686,789 filed on Jul. 26, 1996, now U.S. Pat. No. 5,788,525.

BACKGROUND OF THE INVENTION

1. Field of the Invention

The invention is directed to the field of theft proof lamps and more particularly to adapters which can be used with expensive lamps to prevent their unauthorized removal from lampsockets.

2. Description of the Invention

The prior art known of embodies various types of enclosures or cages which are held in place by a lock in the device itself or a lock applied to the device when closed.

These enclosures often interfere with the changing of the lamps, may restrict the light coverage of the fixture or project unwanted shadows. The locks are easily broken or picked.

SUMMARY OF THE INVENTION

The instant invention overcomes the difficulties noted above with respect to prior art devices by providing an adapter that interfaces with the lamp or other electrical device and the electrical lampsocket into which it is assembled without having any portion which overlaps any part of the lamp or other electrical device. The lamp or electrical device has an insulating body member to which it is mechanically and electrically joined. Placed about one end of the body member is a hollow, metal screwshell means which has an external thread to match the internal screw thread of a lampsocket to permit the screwshell means to threadably engage the lampsocket thread to advance the screwshell into the lampsocket or permit its withdrawal from such lampsocket.

Adjacent the end of the body member containing the screwshell means thereon is a coupling means which couples the screwshell means to said body member permitting the relative rotation of the screwshell means and body member while providing electrical continuity between one element of the lamp and the screwshell means. A flat, central contact is placed at the end of the body member having the screwshell means thereabout to engage the central contact of the lampsocket into which the adapter is placed. This central contact is electrically connected to the second element of the lamp.

The body member has a slot directed inwardly from its surface, parallel to the central longitudinal axis of the adapter and terminates along a line or longitudinal axis parallel with and spaced apart from said central longitudinal axis. Along the top edge of the screwshell means, remote from said central contact are a series of open slots.

To advance the adapter or withdraw it from a lampsocket, a tool or key having a blade that matches the slots of the body member and screwshell means is employed. The body member or screwshell means is rotated until one of the screwshell open slots is aligned with the slot or key way in the body member. The key blade is placed in the aligned slots locking the screwshell means to the body member so that no relative rotation is possible. The adapter can now be made to threadably engage the lampsocket and advanced fully into the lampsocket. The key is removed. With the removal of the key, the body member is free to turn independent of the screwshell means thereby preventing removal of the adapter and attached lamp or electrical device. To remove the adapter, the key is again placed in aligned slots in the body member and screwshell means and the adapter is removed by rotating the adapter. It is an object of this invention to provide an anti-theft lamp adapter.

It is an object of this invention to provide an anti-theft lamp adapter which does not interfere with the operation of the associated lamp.

It is a further object of this invention to provide an anti-theft lamp adapter which employs a special tool and cannot be operated by ordinary, available tools.

Other objects and features of the invention will be pointed out in the following description and claims and illustrated in the accompanying drawings, which disclose, by way of example, the principles of the invention, and the best modes which are presently contemplated for carrying them out.

BRIEF DESCRIPTION OF THE DRAWINGS

In the drawings in which similar elements are given similar reference characters.

DESCRIPTION OF THE PREFERRED EMBODIMENTS

Figure 1:
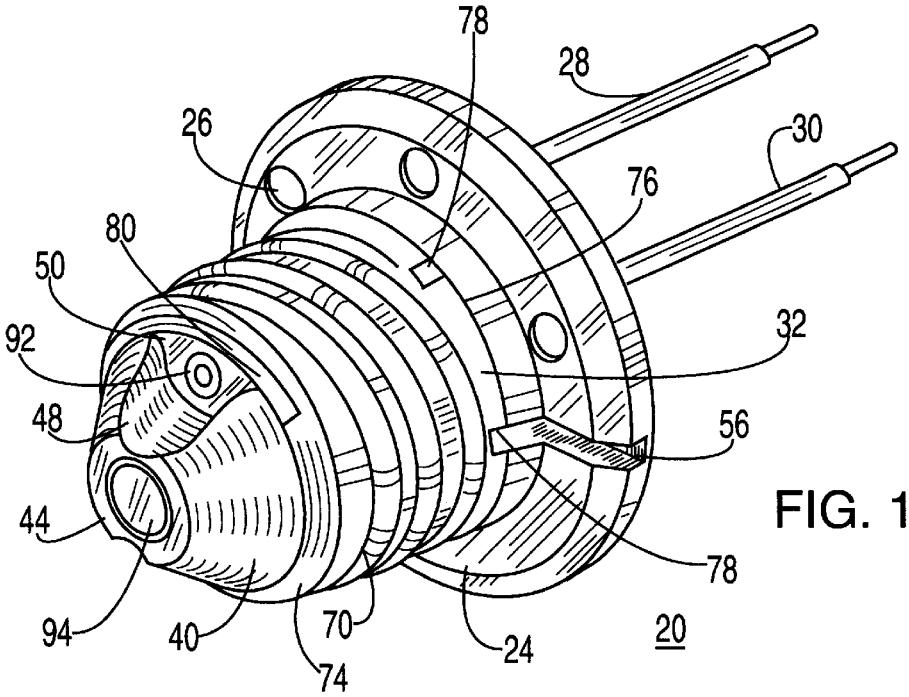
FIG. 1 is a top, right perspective view of an anti-theft lamp adapter constructed in accordance with the concepts of the invention.
Figure 2:
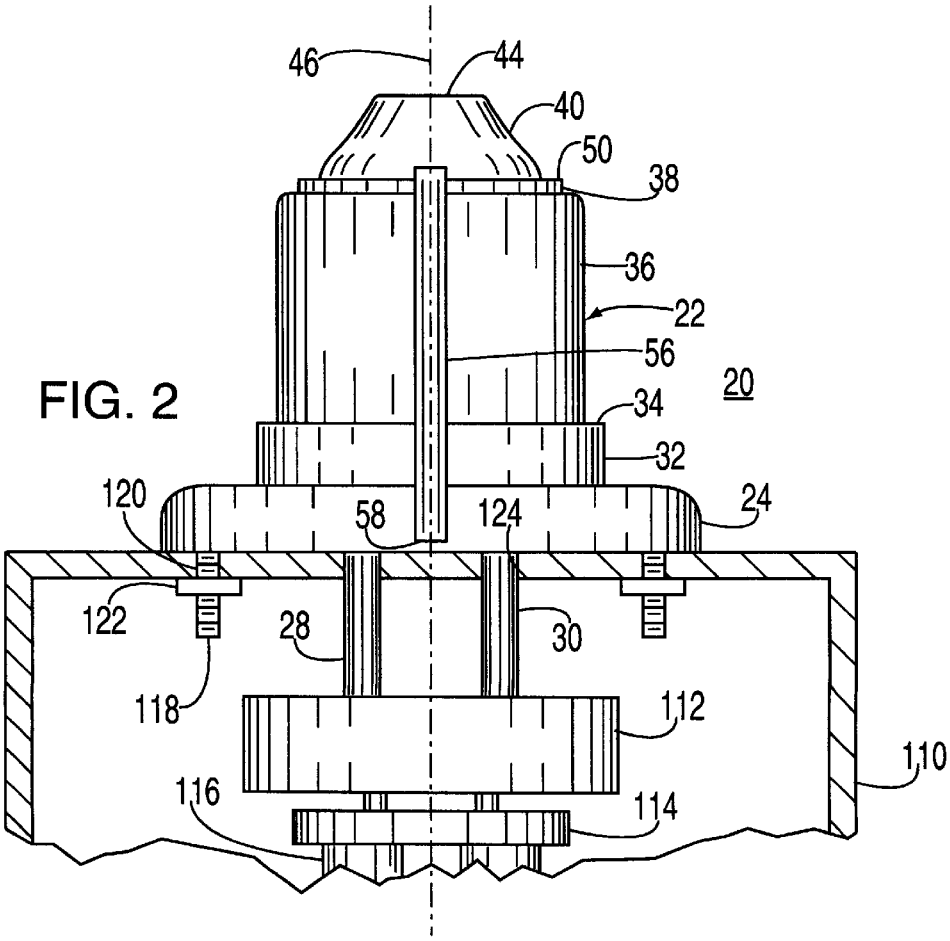
FIG. 2 is side elevational view of the body member of the adapter of FIG. 1 mounted upon a fragmentary portion of an enclosure shown in section.

Turning now to FIGS. 1 to 9, there is shown one form of adapter 20 constructed in accordance with the concepts of the invention. This adapter 20 has a body member 22 fabricated of insulating material, such as rubber, plastic, phenolic or the like. Body member 22 has a first cylindrical portion or flange 24 of a first diameter and thickness. As shown in FIG. 1, there are a member of apertures 26 spaced along flange 24 which can be used to fasten adapter 20 to a housing 110 which contains an electrical device as shown in FIG. 2. The electrical device may be a ballast transformer 112 connected to a dual socket 114 for fluorescent lamps 116. The housing 110 is mounted to flange 24 by means of bolts 118 passed through apertures 26 in flange 24 and apertures 120 in housing 110 and nuts 122 tightened upon such bolts 118. The insulated conductors 28 and 30 pass through an aperture 124 in housing 110 and are connected to the transformer 112 and socket 114. Body member 22 has a second cylindrical portion 32 of lesser diameter than first portion 24 and has a surface 34 which acts as an upper stop for the screwshell member. Portion 32 is about as thick as portion 24. A further cylindrical portion 36 is of smaller diameter than portion 32 and is of much greater thickness than portion 32. A cylindrical step 38 of lesser diameter than portion 36 and of small thickness leads to a truncated conical end 40 of lesser diameter than step 38 and a truncated end surface 44 perpendicular to central longitudinal axis 46.

Figure 3:
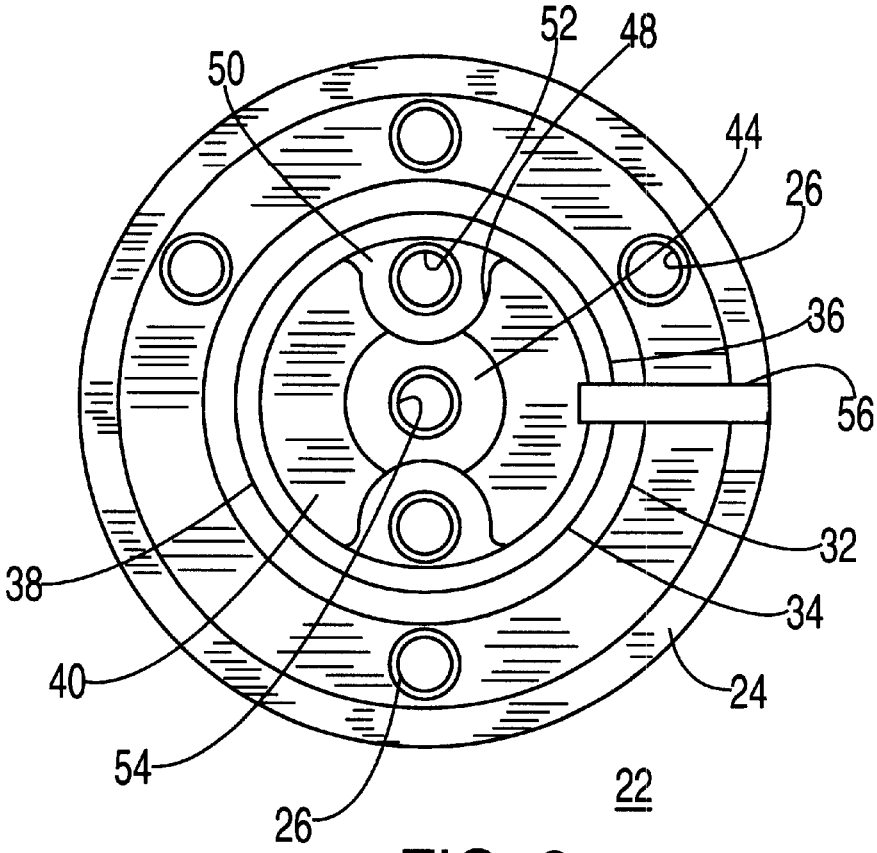
FIG. 3 is a top plan view of the body member of FIG. 2.

As best seen in FIG. 3, there are two depressions 48 in the sides of conical end 40 set at positions 180° apart which expose a portion of the upper surface 50 of step 38. An aperture 52 is placed in each of the exposed surfaces 50. A further aperture 54 is placed in end surface 44.

The arrangement of the component parts of the adapter 60 for the compact fluorescent tubes (see FIGS. 10 and 11) is generally similar to that described above with respect to FIGS. 1 to 9. The difference is that the relatively thin flange 24 is replaced with a much thicker first cylindrical portion 62. The remaining portions are the same.

Figure 10:
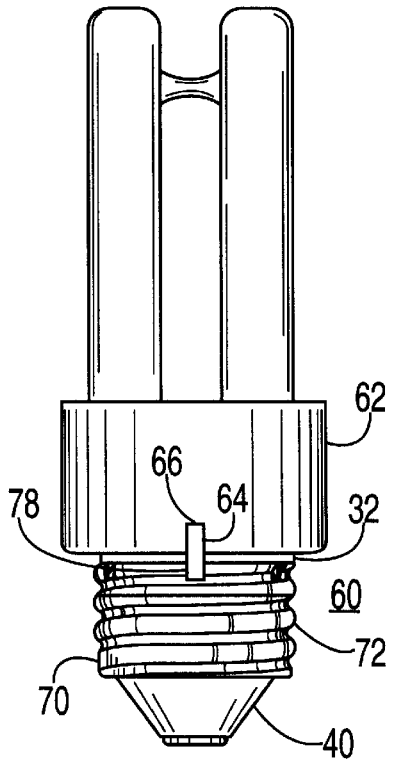
FIG. 10 is a side elevational view of a compact dual tube fluorescent lamp with an adapter according to the instant invention.
Figure 11:
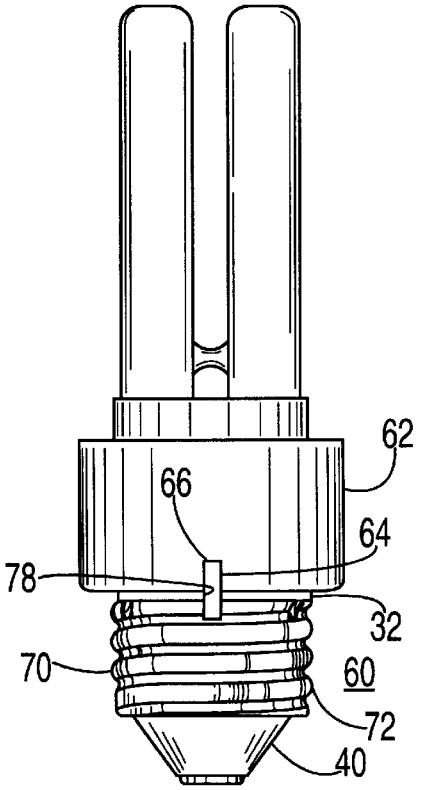
FIG. 11 is a side elevational view of a compact quad-tube fluorescent lamp with an adapter according to the instant invention.

As shown in FIG. 2 a slot or keyway 56 extends through the upper portion of first cylindrical portion 24 adjacent second cylindrical portion 32, the second cylindrical portion 32, third cylindrical portion 36, cylindrical step 38 and into conical end 40. Although it is simpler to manufacture the body member 22 with the slot 56 as described, the slot or key way 56 could be stopped at a point just below the open slots of the screwshell means to be described below. The slot 56 does not extend for the entire thickness of flange 24 resulting in a stop 58 to insure proper positioning of the tool to be described below. Because the cylindrical portion 62 of the adapter 60 of FIGS. 10 and 11 are very thick it is only necessary that the slot or keyway 64 extend into cylindrical portion 62 for a short distance to provide stop 66. Again, slot or keyway 64 could be made long enough to extend beyond the slots of the screwshell means to be described.

Figure 9:
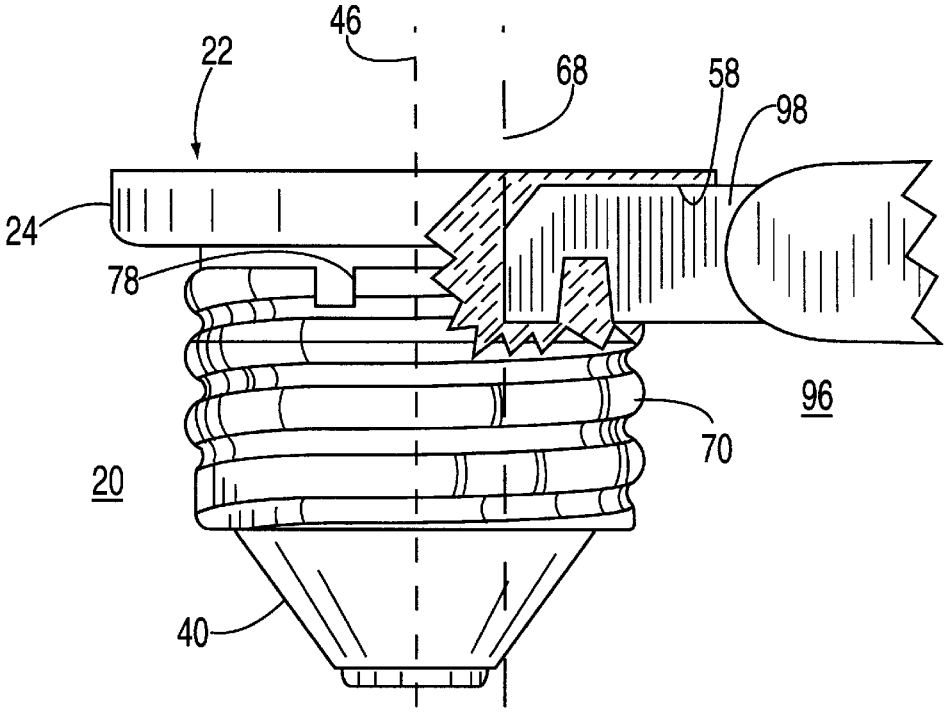
FIG. 9 is a fragmentary side elevational view, partly in section, of the adapter of FIG. 1 with the tool of FIG. 8 in place.

The slot or keyway 56 extends into body member 22 to a depth along the longitudinal axis 68 which is parallel with and offset from the central longitudinal axis 46 (see FIG. 9).

Figure 4:
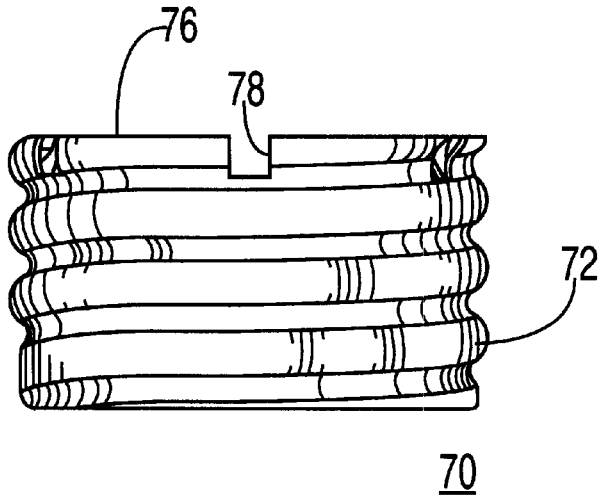
FIG. 4 is a side elevational view of the screwshell means of the adapter of FIG. 1.
Figure 5:
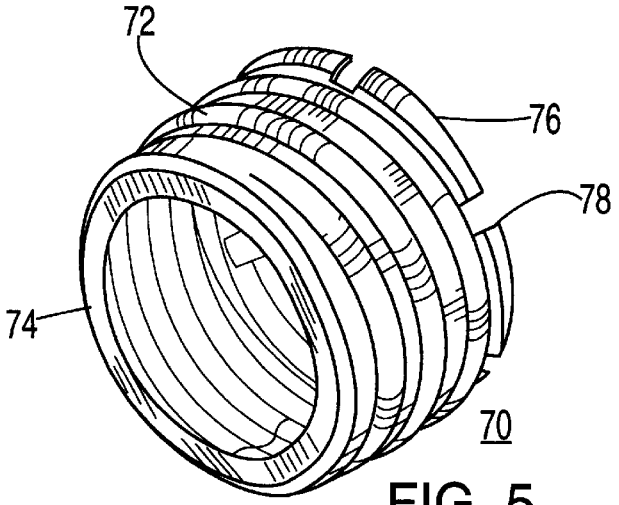
FIG. 5 is a top, right perspective view of the screwshell means of FIG. 4.

The screwshell means 70 is shown in FIGS. 4 and 5. The screwshell means 70 is a hollow cylinder into which is formed a helical thread 72 of the size and pitch of a chosen lamp base, for example, a medium or mogul base lamp. The top lip 74 is intumed to ride over surface 50 of step 38 and the bottom edge 76 has a number of open slots 78 arranged along it. The portion of thread 72 below the closed end of slots 78 engages the surface 34 of cylindrical portion 32 to make relative rotation of screwshell means 70 and body member 22 easier.

Figure 6:
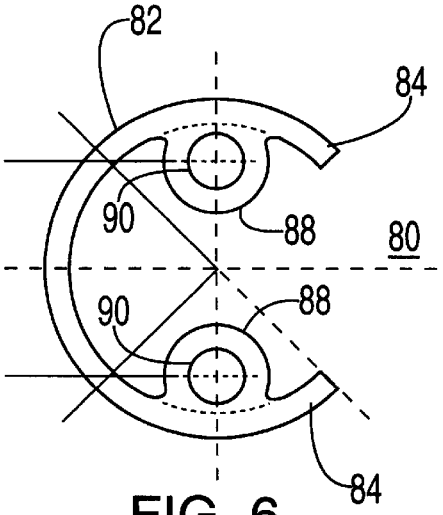
FIG. 6 is a top plan view of the coupling means of the adapter of FIG. 1.
Figure 7:
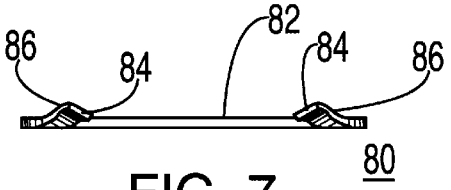
FIG. 7 is a side elevational view of the coupling means of FIG. 6.
Figure 8:
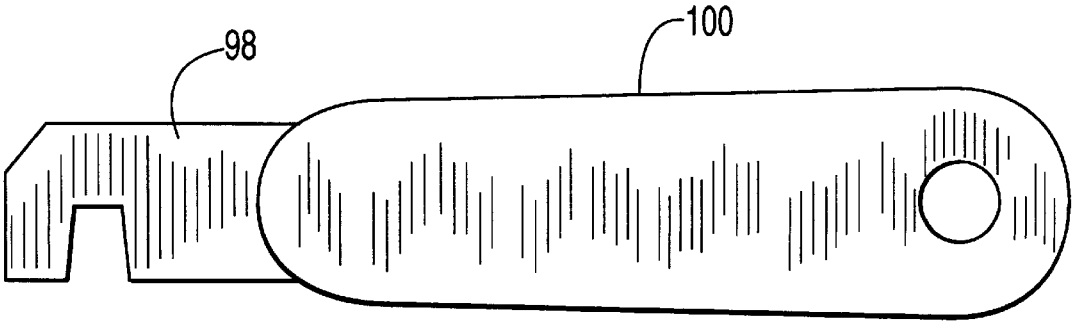
FIG. 8 is a side elevational view of a tool which can be employed with the adapters of the instant invention.

The screwshell means 70 is retained on body member 22 by means of contact washer 80 shown in FIGS. 6 and 7. Contact washer 80 is comprised of a generally C-shaped ring 82 of electrically conductive, spring stock material such as copper or berylium-copper alloys. The ends 84 of ring 82 are bent out of the plane of ring 82 and may be formed with a rounded contact pad 86 as shown in FIG. 7. Extending inwardly from the inner edge or ring 82 are a pair of ears 88, each having an aperture 90 therethrough. After the screwshell means 70 has been placed over step 38 and cylindrical portion 36 of body member 22, the contact washer 80 is placed over the in-turned lip 74 of screwshell means 70 and each of the ears 88 is allowed to extend into its associated depression 48 so that apertures 90 overlie apertures 52. The pads 86 of contact washer 80 are in contact with inturned lip 74 of screwshell means 70. The contact washer 80 is then fixed in place by rivets 92 as shown in FIG. 1. A first insulated conductor 28 is connected to contact ring 80 and by its engagement with screwshell means 70 provides a closed path to one contact or one side of the filament of a lamp or other electrical device. A central contact 94 is positioned on end surface 44 of conical end 40 and fixed thereto and connected via aperture 54 in end surface 44 to the second insulated conductor 30 to provide a closed path to the second contact or the other side of the filament of a lamp or other electrical device. Thus when adapter 20 is screwed into a proper sized lampsocket as shown in FIG. 12 which is connected to a source of electric current and the control switch (not shown) closed, the lamp or other electrical device connected to insulated conductors 28, 30 will be operated.

Figure 12:
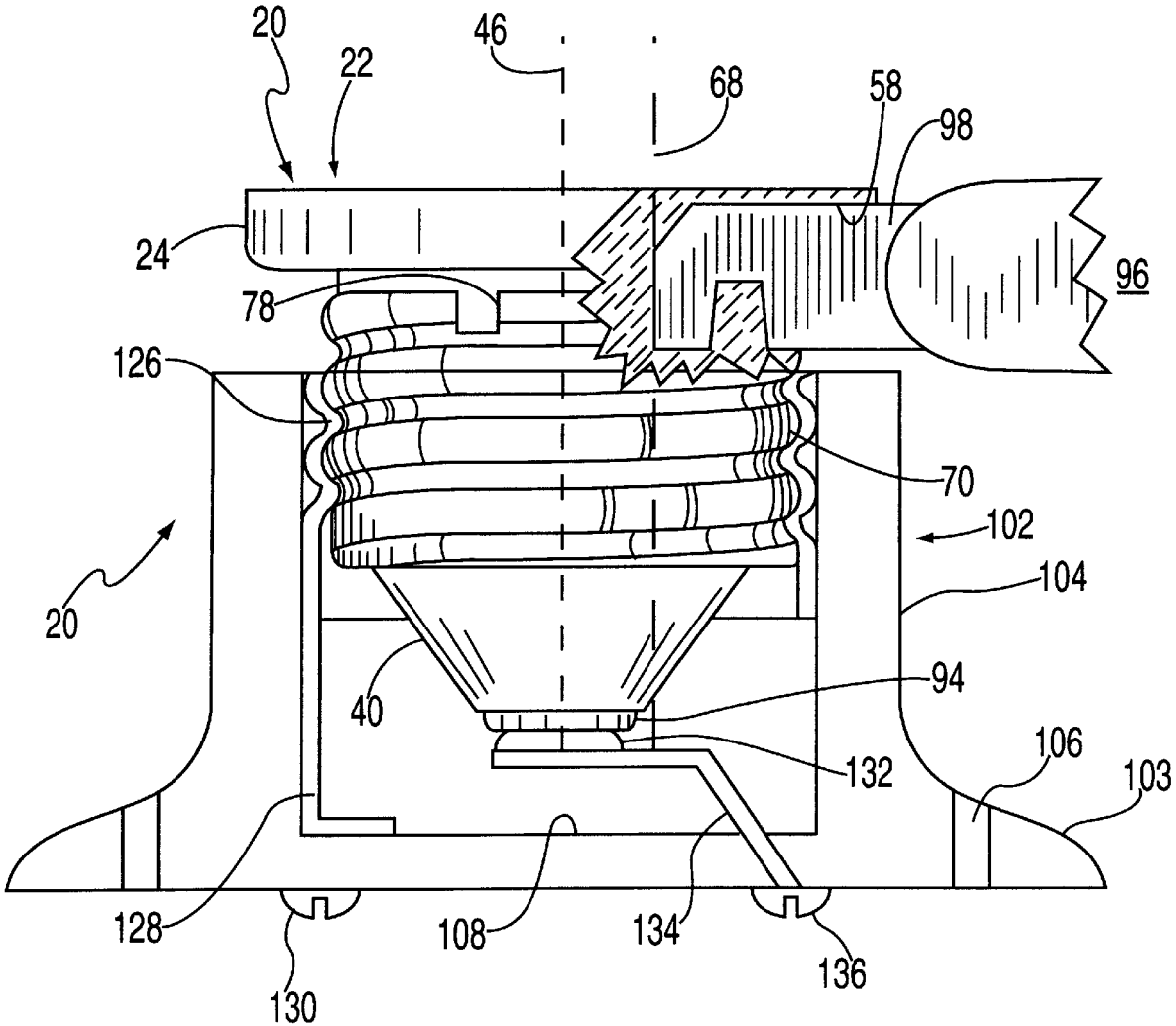
FIG. 12 is a side elevational view of the installation and removal of the adapter of FIG. 1 to a lampsocket.

FIG. 12 shows the adapter of FIG. 1 screwed into a lampsocket 102. Lampsocket 102 is made of an insulating material such as porcelain, rubber or plastic and is generally circular in cross-section. An annular flange 103 surrounds the main body portion and contains at least two aperture 106 which permit fasteners (not shown) to be passed through to fasten the lampsocket 102 to a gang box, a ceiling, wall or the like (not shown). In the central bore 108 there is located a screwshell 126 having an internal helical screw thread corresponding to the external helical screw thread 72 of screwshell means 70. Screwshell 126 is coupled by lead 128 to a terminal screw 120, which can be coupled to one side of an electrical supply (not shown). The central contact 94 of the adapter 20, when the adapter 20 is fully seated in screwshell 126, engages the central contact 132 of lampsocket 102. Central contact 132 is coupled to the second side of the electrical supply by resilient arm 134 coupled to a further terminal screw 136 to which the second side of the electrical supply is connected (not shown).

Since the screwshell means 70 and body member 22 are free to rotate with respect to one another it would not be possible to threadably advance or the threadably withdraw the screwshell means 70 from a lampsocket by rotating the body member 22 by gripping flange 24 or cylindrical portion 62 of adapter 60 and turning them. To do this, it is necessary to assemble, at least temporarily, the body member 22 and the screwshell means 70. This is done with the tool or key 96 shown in FIG. 8. The tool or key has a blade 98 with a thickness less than the width of slot or keyway 56 and is long enough to extend to the rear of the slot 56 defined by longitudinal axis 68 in FIGS. 9 and 12 at the same time extend beyond the outer surface of screwshell means 70. The blade 98 can extend to an insulated handle 100 or can end beyond flange 24 so that it can easily be gripped without the use of a handle.

The screwshell means 70 or body member 22 are rotated until one of the open slots 78 of screwshell means 70 is aligned with slot or keyway 56. Then the tool or key blade 98 is inserted so that it extends all the way back to the line of the longitudinal axis 68 and in engagement with stop 58. The blade 98 is also positioned in an open slot 78. With the elements in this position, as shown in FIGS. 9 and 12, the screwshell means 70 and the body member 22 cannot rotate independently but rotate as a single unit. The adapter 20 may now be made to threadably engage the thread 126 of the lampsocket 102 and advanced until fully seated. The tool or key 96 is removed and the screwshell means 70 and body member 22 are again free and will rotate with respect to one another making removal nearly impossible. To remove the adapter 20 from the lampsocket 102, the tool or key 96 is again inserted into slot or keyway 56 and open slot 78 and the body member 22 is rotated to remove the adapter 20 from the lampsocket.

The installation and removal of the adapters 60 of FIGS. 10 and 11 will be the same as that described with respect to adapter 20.

While there have been shown and described and pointed out the fundamental novel features of the invention as applied to the preferred embodiments, it will be understood that various omissions and substitutions and changes of the form and details of the devices illustrated and in their operation may be made by those skilled in the art, without departing from the spirit of the invention.

The embodiments of the invention in which an exclusive property or privilege is claimed are defined as follows:

1. A method to prevent the theft of electrical lamps from an electrical lampsocket having an internally threaded portion comprising the steps of:

a) providing an insulative body member having at least one cylindrical portion with a slot extending for at least a portion of said cylindrical portion, said body member having an electrical lamp electrically and mechanically connected thereto;

b) positioning a hollow cylinder screwshell means having an external thread around said cylindrical portion and further having a plurality of open slots along a first edge of said screw shell means, said slot in said cylindrical portion alignable with one of said open slots in said screwshell means;

c) locking said screwshell means to said body member by inserting a key in both of said slot in said cylindrical portion and said aligned slot in said screwshell means;

d) threadably engaging the external threads of said screwshell means with said internal threads of an electrical lampsocket;

e) rotating said screwshell means in a first direction to advance said screwshell means into said lampsocket until an electrical circuit to said electrical lamp is completed; and f) removing said key and thereby preventing any rotary motion applied to said body member being applied to said screwshell means thereby preventing the removal of said screwshell means from said electrical lampsocket and the theft of said electrical lamp.

2. A method, as defined in claim 1, comprising the further steps of:

a) rotating said body member until said slot in said cylindrical portion of said body member is aligned with one of said open slots in said screwshell means;

b) inserting said key in said slot in said cylindrical portion of said body member and the aligned open slot in said screwshell means to lock said body member and said screwshell means together; and c) rotating said body member in a second direction opposite said first direction to remove said screwshell means external threads from said electrical lampsocket internal threads to permit said screwshell means to be separated from said electrical lampsocket.

* * * * *